United States Patent [19]

Arbir et al.

[11] 4,078,888

[45] Mar. 14, 1978

[54] FUNGAL PROTECTION FOR LEATHER

[75] Inventors: Francis Walter Arbir, Itasca; Frank Carl Becker, Gurnee, both of Ill.

[73] Assignee: Abbott Laboratories, North Chicago, Ill.

[21] Appl. No.: 724,684

[22] Filed: Sep. 20, 1976

[51] Int. Cl.[2] ..... C14C 3/00

[52] U.S. Cl. ..... 8/94.19 R; 8/94.18; 8/94.33

[58] Field of Search ..... 8/94.19 R, 94.18, 94.33

[56] References Cited

U.S. PATENT DOCUMENTS

| | | | |
|---|---|---|---|
| 2,725,382 | 11/1955 | Harman | 260/306 |
| 3,484,473 | 12/1969 | Buckman et al. | 260/453 |
| 3,512,918 | 5/1970 | Endres et al. | 8/94.24 |
| 3,615,745 | 10/1971 | Crovetti et al. | 106/15 |
| 3,832,130 | 8/1974 | Weaver et al. | 8/94.18 |

OTHER PUBLICATIONS

Amer. Leather Chem. Assoc., vol. 69, July-Dec., 1974, pp. 349-361, 280-289.

*Primary Examiner*—John Kight, III

*Attorney, Agent, or Firm*—Paul D. Burgauer; Robert L. Niblack

[57] ABSTRACT

4-Tolyl diiodomethyl sulfone has been found to protect leather from fungal attack if it is incorporated into the tanning mixture in suitable amounts.

3 Claims, No Drawings

FUNGAL PROTECTION FOR LEATHER

DETAILED DESCRIPTION OF THE INVENTION

The manufacture of leather from animal hides is an ancient art which has basically remained unchanged over the centuries, with the exception of various additives to the tanning mixture for one purpose or another. The process involves several pre-tanning steps which are necessary to remove undesirable portions from the surface of the hide. Subsequently, the hide is tanned, dyed, lubricated and may need other finishing operations.

In modern times, various additives have been used in one or the other of these operations to improve the final product finish or its durability. In particular, anti-fungal agents have been added to the tanning mixture or to the coatings used for dyeing or lubricating the final product.

It has now been found that leather can be protected against fungal attack by incorporating into the tanning mixture between 0.4 and 1.8 g of 4-tolyl diiodomethyl sulfone (4-TDS) for each 10 kg of leather. This addition to the tanning solution does not affect the appearance, feel, odor or the physical properties of the leather.

The new protective process is effective whether it is used on fleshed or pre-fleshed hide or in hide-processor or in wooden drum equipment. It is particularly interesting that the difficult winter-kill hides ar protected as efficiently by the new additive as the summer-kill hides.

In a general embodiment of the current process, the tanning mixture used is augmented by the addition of 4-TDS in a concentration to provide 0.4–1.8 g/10 kg of leather. Tanning is allowed to proceed in the standard fashion, either in modern type hide processing equipment, referred to in the trade simply as "hide processor", old-fashioned drums or other closed containers used for such a purpose. Since the 4-TDS is readily dispersible in ordinary tanning formulations, no special or different precautions need to be observed; the 4-TDS can be added as a dry powder or it may be combined with the tanning formulation in a concentrated organic solution.

In order to illustrate the effect of the new invention, reference is made to the following examples which, however, are not meant to limit the invention in any respect. In all of the examples, a mixture of equal concentration was used of Aspergilli (A. *repens*, A. *terreus*, A. *niger* and A. *flavus*), Penicillia (P. *verruculosum*, P. *diversum*, P. *oxalicum* and P. *spinulosum*), *Rhizopus arrhizus*, *Myrothecium verrucaria* and Gliocladium sp. as prescribed by the American Leather Chemist Association (A.L.C.A.).

EXAMPLE 1

Unpreserved bluestock was treated in the laboratory under agitation for 7 hrs. at 32.5° C in a standard chrome-tan solution to which was added 4-TDS or a commercial anti-fungal compound at various levels.

Of these tanned leathers, 2.5 cm discs were punched and placed in 100 mm Petri dishes. Potato dextrose agar was poured level with each sample and allowed to solidify. The agar samples were then inoculated with the above inoculum containing 10,000 spores/ml of each of the eleven species.

Two weeks after inoculation, the agar plates were examined for the extent of fungal growth. The observation was rated on a scale of 0–5, 0 indicating no sign of growth, 5 indicating a substantially total cover of the discs with fungus. The observations were made on three samples per test and the results of all three leather samples were averaged and entered in Table I under M.R. (= mean result) in the "laboratory" entries.

In a further test, larger leather samples were treated in a pilot plant drum with the same chrome-tan solution. The same inoculum and agar plate method was used. The result is also shown in Table I.

In both instances, the amount of the additive is shown on the basis of 10,000 kg hide.

TABLE I

| Amount Added | Test Site | Process | Hide | M.R. |
|---|---|---|---|---|
| 1.8 kg. 4-TDS | laboratory | — | pre-fleshed | 0 |
| 1.8 kg. 4-TDS | pilot plant | drum | pre-fleshed | 0 |
| 10 kg.TPh-Na* | laboratory | — | pre-fleshed | 3.3 |

*Sodium 2,4,6-trichlorophenolate

EXAMPLE 2

In a full-scale commercial operation, hides were tanned with standard chrome-tan solutions in the customary fashion but using the 4-TDS anti-fungal additive in the amount shown in Table II or a commercially used older anti-fungal agent.

(a) From each tanned hide, 2.5 cm discs were taken and 15 discs per hide treatment were used in a laboratory test method comprising placing these discs on a glass rod which, in turn, is placed in a glass jar. Each disc then received the mixed spore inoculum shown in Example 1 in an amount of approximately 1,000 spores. The jars were incubated at 30° C for 4 weeks and the results were again averaged over the 15 samples per hide treatment, using the rating system of Example 1. These mean results are shown in Table II.

(b) Hides were treated as shown in Example 2(a); they were placed in polyethylene packs as splits of half a hide, 5 splits per pack. These packs were stored for 4 weeks at 25° C and then examined for fungal growth. The results are shown in Table II with the added fungicide calculated on the basis of 10,000 kg. of hide.

TABLE II

| Amount Added | Process | Hide | Jars | Pack |
|---|---|---|---|---|
| 1.22 kg. 4-TDS | H.P.* | pre-fleshed | 2.0 | 3.3 |
| 1.22 kg. 4-TDS | drum | pre-fleshed | 1.6 | 0.5 |
| 1.22 kg. 4-TDS | drum | fleshed | 0.3 | 0.1 |
| 5.66 kg. TPh-Na | H.P. | pre-fleshed | 0.7 | 0.9 |
| 5.66 kg. TPh-Na | drum | pre-fleshed | 0.3 | 0.0 |
| 5.66 kg. TPh-Na | drum | fleshed | 0.3 | 0.1 |
| none | drum | pre-fleshed | 5.0 | |

*Hide-processor

From the above tests it will be seen that a fraction of the amount of 4-TDS produces essentially equivalent protection for leather against fungal growth as is obtained by the commercially standard amounts used of other additives.

The new additive provides the demonstrated excellent protection not only with very small and economical amounts, but it does this without causing any adverse effects on the leather so treated. In addition, the new additive is very easy to work with: It is a non-hygroscopic powder, melting at 147°–150° C with a specific gravity of 2.2 g/ml and has an oral $LD_{50}$ in rats of 9.4 g/kg. Thus, its use is extremely safe. It can be incorporated into the tanning solution as a free-flowing, dry powder or it can be combined therewith as an organic solution or concentrate, which is very easily dispersible in water. Either form mixes readily with standard tanning liquids such as the chromium sulfate and sulfuric acid, and others, and it may be added whether the hide is pre-fleshed or fleshed and whether it is processed in a hide processor or the drum type tanning equipment.

What is claimed is:

1. The process of protecting leather against fungal attack comprising the step of tanning a hide in a tanning fluid containing the standard tanning ingredients and between 0.4 and 1.8 of 4-tolyl diiodomethyl sulfone per 10 kg of hide for a period sufficient to complete the tanning process.

2. The process of claim 1 wherein said tanning is carried out in hide processing equipment.

3. The process of claim 1 wherein said tanning is carried out with pre-fleshed hides.

* * * * *

UNITED STATES PATENT AND TRADEMARK OFFICE

CERTIFICATE OF CORRECTION

PATENT NO. : 4,078,888

DATED : March 14, 1978

INVENTOR(S) : Francis Walter Arbir, Frank Carl Becker

It is certified that error appears in the above-identified patent and that said Letters Patent are hereby corrected as shown below:

In column 4, line 1, please add "g" after 1.8.

Signed and Sealed this

*First* Day of *August 1978*

[SEAL]

*Attest:*

RUTH C. MASON
*Attesting Officer*

DONALD W. BANNER
*Commissioner of Patents and Trademarks*